United States Patent [19]

Lenz

[11] 3,971,022

[45] July 20, 1976

[54] PHASED-ARRAY ANTENNA EMPLOYING AN ELECTRICALLY CONTROLLED LENS

[75] Inventor: Karl-Ludwig Lenz, Krailling, Germany

[73] Assignee: Siemens Aktiengesellschaft, Berlin & Munich, Germany

[22] Filed: Jan. 20, 1975

[21] Appl. No.: 542,365

[30] Foreign Application Priority Data

Feb. 6, 1974 Germany ..... 2405520

[52] U.S. Cl. ..... 343/754; 343/100 SA; 343/854

[51] Int. Cl.[2] ..... H01Q 3/26

[58] Field of Search ..... 343/754, 854, 100 SA

[56] References Cited

UNITED STATES PATENTS

| | | | |
|---|---|---|---|
| 2,986,734 | 5/1961 | Jones et al. | 343/754 |
| 3,430,242 | 2/1969 | Safran | 343/854 |

*Primary Examiner*—Eli Lieberman

*Attorney, Agent, or Firm*—Hill, Gross, Simpson, Van Santen, Steadman, Chiara & Simpson

[57] ABSTRACT

A phased-array antenna in which transmitting energy from a primary feed system is radiated through free space as a primary wave to a plurality of first radiator elements, where they are received, and conducted over a plurality of phase shift elements, which may be electronically controlled, and which convert the primary wave into a planar wave and additionally effect a desired beam deflection, with such waves being radiated by a plurality of second radiator elements, in the form of a planar wave with received energy passing in the opposite direction along the same path, in which a second primary feed system is disposed at the second radiator elements and also supplied with transmitting energy which is radiated through free space, as a primary wave, to the second radiator elements where it is received, conducted over said phase shift elements and radiated by the first radiator elements in the form of a planar wave.

15 Claims, 11 Drawing Figures

PHASED-ARRAY ANTENNA EMPLOYING AN ELECTRICALLY CONTROLLED LENS

BACKGROUND OF THE INVENTION

The invention is directed to a phased-array antenna in which transmitted energy from a primary feed system is radiated through free space as a primary wave to a plurality of first radiator elements, preferably arranged in rows and columns in a single plane, where they are received, conducted over a plurality of phase shift elements which may be electronically controlled and which convert the primary wave into a planar wave, and which in addition, effect a desired beam deflection, and subsequently emitted by a plurality of second radiator elements, in the form of a planar wave. The second radiator elements likewise preferably are arranged in rows and columns in a single plane and are correspondingly disposed with respect to the first radiator elements. In like manner, receiving energy may pass, in the opposite direction, along such path.

In a radiation-fed, electronically controlled antenna, the high frequency power produced in a transmitter is conducted over a primary feed system, by radiation, to the antenna elements at the aperture. The aperture comprises a plurality of antenna elements, for example, dipoles, which are usually arranged on a flat surface of specific geometric configuration.

In order to produce the directional operation of the antenna, the differences in transit time resulting from different distances of the individual and planar elements from the primary feed system must be compensated, which may be termed "focusing". The deflection of the antenna beam is derived by means of a phase delay which is linearly dependent upon the coordinates of the aperture, and of the currents in the individual antenna elements. The phase is usually controlled by electronically variable phase shift elements.

The focusing of the primary beam may be effected either through electrical delay lines which are of different length and are individually calculated and produced for each antenna element, and which are subsequently connected to the phase shift elements, or else in the phase shift elements per se. The adjustment or control of the phase shift elements comprises two parts, one of which is formed by the required focusing phase, and the other the deflection phase required for a specific beam direction. The adjustment of the phase shift elements is calculated for all the antenna elements in conjunction with a so-called phase calculator. In a phase controlled antenna arrangement of the irradiation type the radiator elements are disposed at both sides of the antenna aperture with the primary wave emitted from the primary feed system impacting against a wall of first radiator elements, the so-called collector radiator elements, and connected to each of these elements is a phase shift element and possibly also a delay line, whereby the high frequency current at this point is influenced with respect to its phase in accordance with the desired beam deflection and the required focusing. The second radiator elements, the so-called emitter radiator elements, are connected to the other side of the respective phase shift elements with the second radiator elements likewise forming a wall which, in their entirety, emit a planar wave in the desired direction of deflection.

All of the known phased-array antenna arrangements of this type have the characteristic that they permit a beam deflection of $x$ 0° to approximately ±45° (maximum ±60°) in relation to the normal of the surface formed by the emitter radiator elements. If all directions of a full azimuth angle range of 360° is to be employed, generally the relatively high outlay of four such flat antenna arrangements will be required, each displaced by 90° in relation to one another.

The monitoring of the full azimuth range also can be achieved by the employment of cylindrical or conical phased-array antenna arrangements which, however, entail extremely complex operating devices merely because it always is necessary to switch off the radiator elements facing in a direction opposite to that from the instantaneous beam direction.

BRIEF SUMMARY OF THE INVENTION

In accordance with the present invention, there is provided a phased-array antenna arrangement of the type heretofore described, in which the outlay required for a full azimuth monitoring is substantially reduced to that of previous arrangements by the provision of a secondary primary feed system disposed at the side of the plane including the second radiator elements, which second primary feed system is also supplied with transmitting energy. Such energy is radiated through free space as a primary wave to the second radiator elements where it is received, conducted across the phase shift elements associated therewith and emitted by the first radiator elements in the form of a planar wave.

Thus, there is a two-sided utilization of the antenna with the first primary feed system irradiating one side of the antenna, and as a result of the associated phase shift elements the energy is suitably focused, and at the same time the phase is suitably controlled for effecting a desired direction of deflection whereby the wave passes to the other side of the antenna from which it is emitted in the desired direction of deflection. In like manner, the second primary feed system irradiates the last-mentioned side of the antenna and is similarly focused and provided with the desired phase shift by means of the same phase shift elements, with the energy then passing, in opposite direction, to the first-mentioned side of the antenna, from which it is emitted.

The first radiator elements thus are arranged on one side of the antenna and the similar second radiator elements are correspondingly arranged on the other side of the antenna whereby it is possible to sweep the full 360° azimuth angle with merely two phase-controlled antennas designed in accordance with the invention, and thus transmitting at both sides of the antenna, as compared with the four phase-controlled antenna arrangements necessary in accordance with the prior art. In the case of the present invention, the two antennas would likewise be rotatively oriented by 90° relative to one another.

BRIEF DESCRIPTION OF THE DRAWINGS

In the drawings wherein like reference characters indicate like or corresponding parts.

DETAILED DESCRIPTION OF PREFERRED EMBODIMENTS OF THE INVENTION

Figure 1:
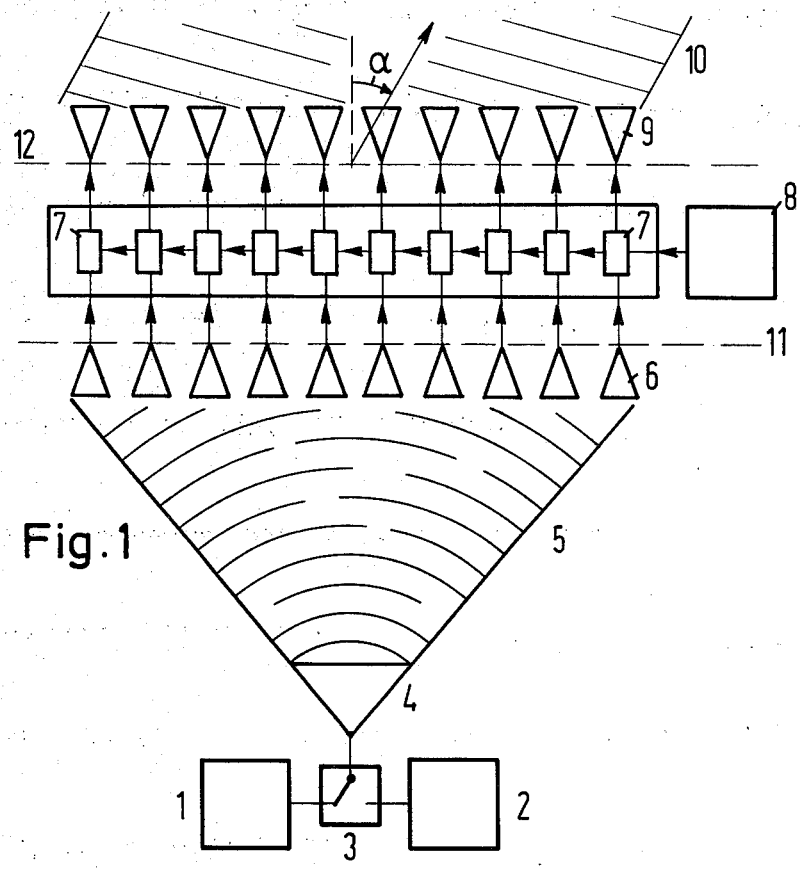
FIG. 1 schematically illustrates a known phased-array antenna which is radiation fed at one side and employs a lens-type construction.

Referring to FIG. 1, the antenna arrangement therein illustrated is of known construction in which a transmitter 1 supplies signals to a receiver 2, in which the switch-over between the transmitter 1 and receiver 2 is effected by means of a transmitting-receiving switch 3. Operatively connected to the latter is a primary feed system, indicated generally by the reference numeral 4, illustrated as being in the form of a horn radiator which emits a primary wave 5, usually a spherical wave. The primary wave 5 emanating from the primary feed system 4, following its passage through free air space impacts a plurality of first radiator elements 6 which are generally disposed in the form of a flat wall structure, with each element 6 being connected to a respective phase shift element 7. The respective phase shift elements 7 are operative to so influence the high frequency current with respect to phase in accordance with the output values of a deflecting computer 8, and adjustable focusing phase values, that a planar wave is transmitted by respective secondary radiator elements 9 in a direction $\alpha$. In other words, the phase shift element 7 transforms the primary wave 5 into at least an approximate planar wave 10. This transformation results from the focusing phase while the deflection phase determines the beam fluctuation of the planar wave 10.

Echo energy passes through the arrangement in the opposite direction and sequence. It will be appreciated that in connection with transmission, the first radiator elements 6 function as collector radiators and lie in a plane 11 while the second radiator elements 9 function as emitter radiators and lie in a plane 12, illustrated as extending parallel to the plane 11. Horn radiators, simple dipoles, folded dipoles or the like, for example, may be employed for the radiator elements 6 and 9.

Figure 2:
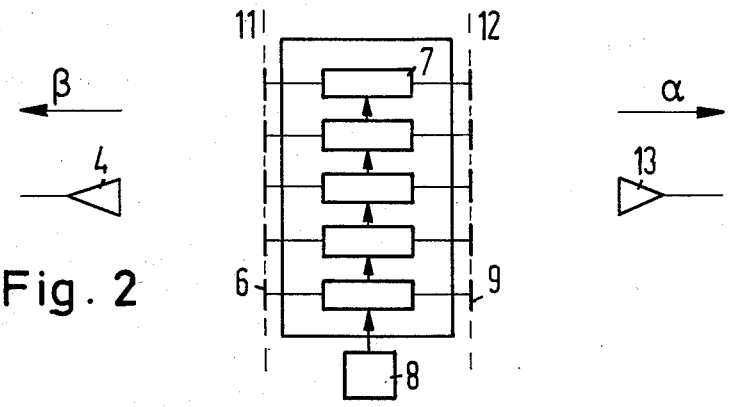
FIG. 2 schematically illustrates phased-array antenna, in accordance with the invention, which is radiation-fed at both sides of the antenna.

FIG. 2 illustrates an antenna arrangements, embodying the present invention, in which two radiation directions are utilized. In this arrangement, the primary feed system 4 irradiates the plane 11 having the first radiator elements 6 disposed therein, with the energy passing over the phase shift elements 7 to the parallel plane 12, which planes in the exemplary embodiment are also coextensive or coincident, and provided with the second radiator elements 9, from which the energy is transmitted in the direction $\alpha$. A second primary feed system 13 irradiates the plane 12 and thus the second radiator elements 9. The received energy thereat likewise passes over the phase shift elements 7 and flows, in the opposite direction to the first radiation, to the plane 11 and the second radiator elements 6, from which it is radiated as a planar wave in the direction $\beta$. The mode of operation and control of the phase shift elements 7 generally corresponds in both directions to those of the arrangement illustrated in FIG. 1. In the embodiment illustrated in FIG. 2, the two primary feed systems 4 and 13 are disposed centrally, directly in front of the two planes 11 and 12, in which positions the focusing and deflection possibly may be more easily calculated in the computer 8.

Figure 3:
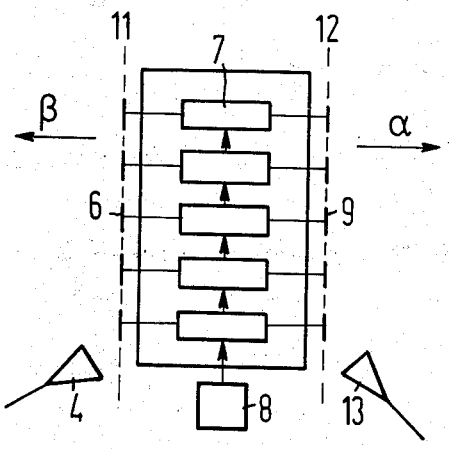
FIG. 3 schematically illustrates a phased-array antenna, in accordance with the invention, in which the two primary feed systems at opposite sides of the antenna are disposed in offset relation with respect to the irradiated surfaces.

FIG. 3 illustrates a similar phased-array antenna employed in two directions, in accordance with the invention, in which the respective primary feed systems 4 and 13 are offset below the lower edge of the flat faces 11 and 12, as viewed in FIG. 3, i.e. off-center with respect to such faces. The plane surfaces 11 and 12 respectively comprising the radiator elements 6 and 9, are then obliquely irradiated from below. This arrangement offers the advantage that the respective primary feed systems 13 and 4 do not throw a shadow on and thus obstruct passage of the beam. The secondary antenna lobes thus remain small and the degree of the surface effectiveness of the antenna is increased. The oblique illumination can be taken into account or compensated in the individual setting up or operation of the phase shift elements 7, for example, by the addition of fixed values or by systematically considering in the digital calculation each new value to be set up with the aid of the phase computer 8.

Figure 4:
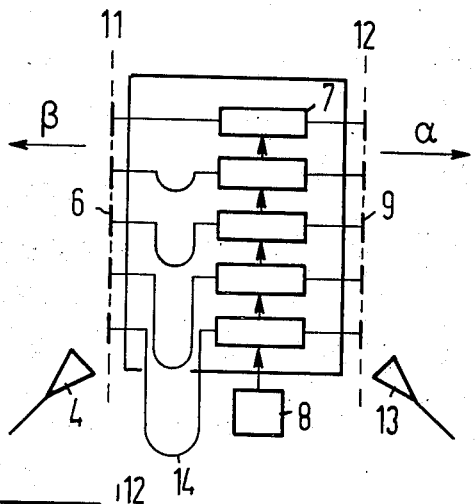
FIG. 4 schematically illustrates a phased-array antenna, in accordance with the invention, employing two off-center primary feed systems, and including delay lines for compensation of the oblique irradiation, as well as possibly for focusing.

As illustrated in FIG. 4, oblique illumination of the two plane surfaces 11 and 12 can be simultaneously compensated for both directions of operation of the antenna, if the two primary feed systems 4 and 13 are arranged symmetrically and the individual phase shift elements 7 are in each case connected between the first and second radiator elements 6 and 9 by respective delay lines 14 of different lengths, which delay lines simultaneously may be employed in connection with the focusing operation.

In all the antenna in accordance with the invention, utilizing both sides thereof, the complementary radiator elements, i.e. the first radiator element 6 and the second radiator element 9, which are each connected to a phase shift element 7, can be designed for different polarization directions, in which case the primary feed systems 4 and 13, in each case directly irradiating such radiator elements at the transmitting end, would have to be correspondingly constructed and matched. A rotation of the polarization planes of the two planar antenna faces 11 and 12 of 90° in relation to one another produces a particularly good decoupling. If both polarization planes are inclined by 45° in relation to the vertical the advantage of identical constructions for the two primary feed systems 4 and 13 is additionally achieved.

Figure 5:
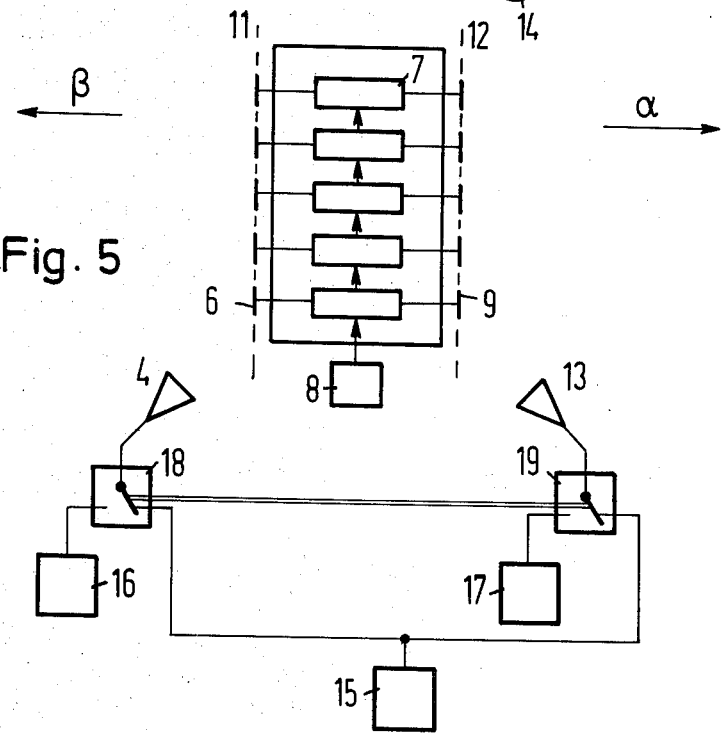
FIG. 5 schematically illustrates a phased-array antenna, in accordance with the invention, which is simultaneously operated in both directions, utilizing a pulse radar transmitter and two receivers, which are illustrated in block form.

FIG. 5 schematically illustrates a phased-array antenna, in accordance with the invention, which is suitable for employment in pulse radar and likewise is operated at both sides, to which are connected a single transmitter 15 and two receivers 16 and 17. In this case, the primary feed systems 4 and 13 are operated simultaneously by the transmitter 15 over two coupled transmitting-receiving switches 18 and 19. If the two switches 18 and 19 operate in common, the two receivers 16 and 17 will be connected to the primary feed systems 4 and 13 and receive the echo signals from the two directions $\alpha$ and $\beta$.

Figure 6:
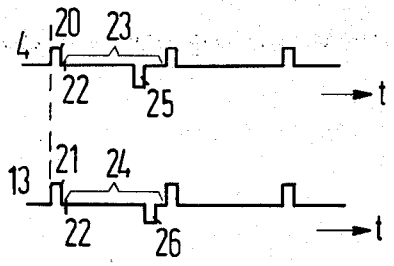
FIG. 6 is a chart illustrating the time sequence of radar pulses transmitted and received, utilizing the circuit illustrated in FIG. 5.

FIG. 6 illustrates a time chart for the circuit example of FIG. 5, in which $t$ = time with the conditions existing in the primary feed systems 4 and 13 illustrated one below the other. When the transmitting-receiving switches 18 and 19 are switched to transmission, a transmitting pulse 20 is emitted to the primary feed system 4 and simultaneously therewith a transmitting pulse 21 is supplied to the primary feed system 13. At time 22 the two coupled transmitting switches 18 and 19 switch over in common, and the receiving periods 23 and 24, of equal length, commence for the two primary feed systems 4 and 13. If during this time a target lies in the range over which the transmitted beam passes, an echo pulse can be received by the primary feed system 4 and/or 13 and conducted to the receivers 16 or 17. Possible receiving pulses are illustrated and designated by the reference numerals 25 and 26.

Figure 7:
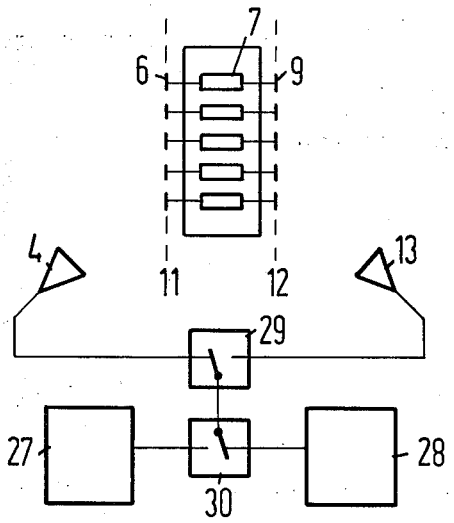
FIG. 7 schematically illustrates a phased-array antenna, in accordance with the invention, in which a single pulse radar transmitter and a signal receiver are employed for irradiation of both sides of the antenna and which operate by means of time division multiplexing.

FIG. 7 schematically illustrates a phase-controlled antenna in accordance with the invention which likewise is suitable for employment in pulse radar is operated on two sides, utilizing a single transmitter 27 and a single receiver 28. Alternately, first one and then the other of the two primary feed systems 4 and 13 are connected over a time division multiplexing switch 29 to the transmitter 27 and during the receiving phase to the receiver 28. A transmitting-receiving switch 30 is therefor provided which after each transmitting pulse switches through the receiver 28 for the duration of one receiving phase.

Figure 8:
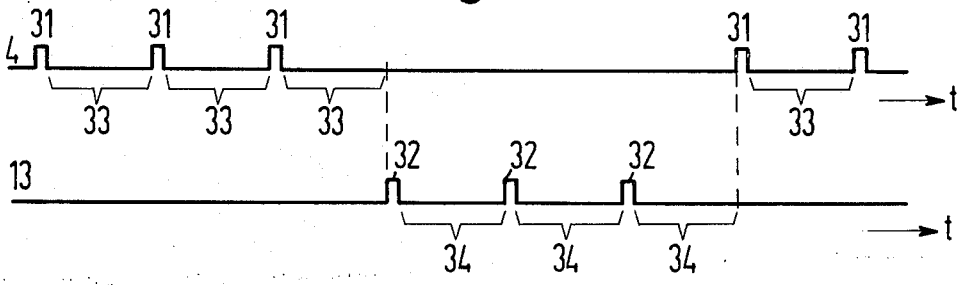
FIG. 8 is a chart illustrating a time sequence of radar pulses transmitted and received, employing the circuit of FIG. 7 with a multiplexing switch-over after several pulses.
Figure 9:
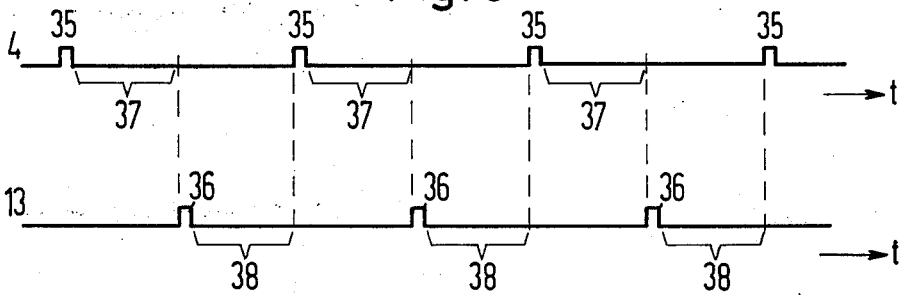
FIG. 9 is a chart similar to FIG. 8 illustrating the time sequence of radar pulses transmitted and received utilizing the circuit of FIG. 7, but with a multiplexing switch-over from pulse to pulse.

FIG. 8 illustrates a pulse chart involving time division multiplex operations in which switch-over between the two primary feed systems 4 and 13 takes place only after relatively long periods of time. Initially several pulses 31 are emitted over the primary feed system 4 and then several, possibly an equal number of pulses 32, are emitted over the primary feed system 13, etc. The receiving periods 33 and 34 respectively following the transmitting pulses 31 and 32 are determined by the transmitting-receiving switch 30 and are illustrated as being of equal length. However, as illustrated in the pulse diagram of FIG. 9 in which $t$ = time, it is also possible to switch over in a pulse-to-pulse sequence between the two primary feed systems 4 and 13. Thus, initially, a pulse 35 is emitted over the primary feed system 4 and then a pulse 36 over the primary feed system 13, etc. with the receiving periods 37 and 38 being of equal time duration and following each transmitting pulse, as determined by the transmitting-receiving switch 30.

Figure 10:
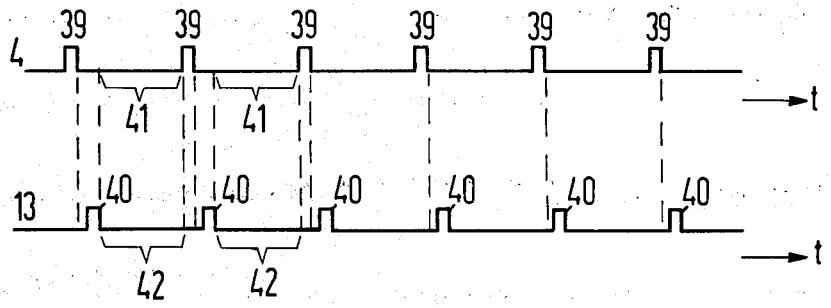
FIG. 10 is a chart similar to FIGS. 8 and 9 illustrating the time sequence of pulses, employing one transmitter in time division multiplex operation and two separate receivers whose receiving periods overlap.

A more favorable exploitation, in terms of time, of the time division multiplex operation, may be achieved by effecting transmission from the two primary feed systems 4 and 13 very shortly one after the other as illustrated in FIG. 10, with the transmitting pulses 30 immediately preceding the transmitting pulses 40. The pulses are then followed by receiving periods 41, associated with the respective pulses 39, and periods 42, associated with the respective pulses 40, of the two systems. Expediently two receivers are employed, for example, one receiver being assigned to all of the receiving periods 41 and the other receiver to all the receiving periods 42. Expediently, each transmitting pulse 39 is immediately followed by a dead period and in similar manner a dead period is interposed before each transmitting pulse 40 and after the end of the receiving period 42, as it is not possible to receive on one channel while the other is transmitting.

All of the illustrated and described types of time division multiplex operations may be extended to the use of different frequencies for the two primary feed systems, and in like manner instead of one single transmitter which is re-keyed in frequency, it is also possible to employ two separate transmitters which operate on different frequencies.

Where echos are to be received in conjunction with two primary feed systems 4 and 13, which are either completely simultaneously or partially overlapping in time, i.e. in situations in which two receivers are likewise required, each beam direction $\alpha$ is rigidly assigned a specific beam direction $\beta$ on the opposite side. However, this does not involve any problems with respect to the systematic investigation of space as in order to tract a previously discovered target in direction $\alpha$, it is not necessary to simultaneously radiate energy in the complementary direction $\beta$. However, as one and the same antenna is generally employed for the searching function for a large percentage of the time, in spite of the rigid coupling of the directions $\alpha$ and $\beta$, the simultaneous operation of both sides of the antenna correspondingly effects considerable savings in scanning time and thus is of great advantage.

Figure 11:
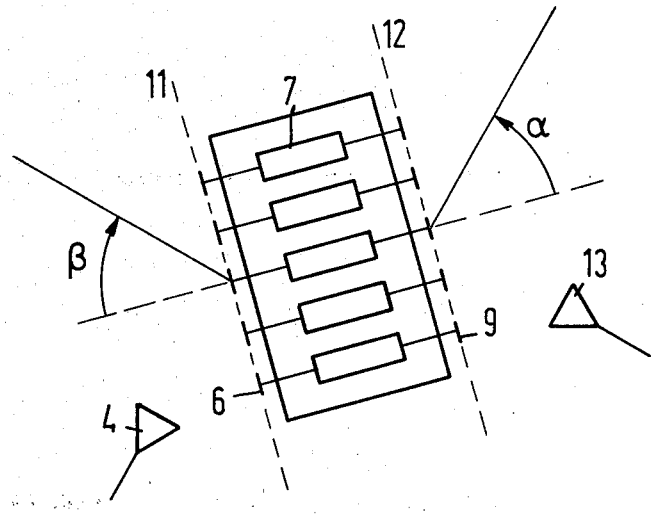
FIG. 11 schematically illustrates a phased-array antenna in accordance with the invention, employed in two directions and disposed in inclined relation with respect to the vertical.

FIG. 11 illustrates a phase-controlled antenna, utilizing both sides for transmission in accordance with the invention, in which the antenna is disposed in inclined relation with respect to the vertical. Such inclined disposition of the two parallel planes 11 and 12 is expedient if there is greater interest in large angles of elevation in the direction $\alpha$ than in the direction $\beta$. In connection with the practice of the invention, reciprocally operating types of phase shift elements, i.e. those having the same phase shift in both directions of propagation, are particularly expedient. However, in specific types of operation of a phase-controlled antenna of this type, it may be desirable to employ non-reciprocal phase shift elements. It will be appreciated that in the design of the phase shift elements they can either be analogue or digital.

All of the possible forms of radiator elements, for example, simple dipoles, folded dipoles, horn radiators, etc. can be employed as radiator elements 6 and 9 on the two flat or curved faces 11 and 12 of a phased-array antenna of this type. It is even possible to employ different embodiments on one face of the antenna than those on the other face. The principal of phased-array antenna utilized on two sides may be employed for both two dimensional arrangements and linear arrangements.

If the full azimuth range of 360° is to be covered by electronic beam deflection, advantageously two such phase-controlled antenna, constructed in accordance with the invention, may be employed with the respective antennas so disposed that the parallel antenna faces of the one are displaced by 90° in the azimuth.

In the past, where a separate transmitting antenna and a separate receiving antenna were employed for specific purposes, if a full azimuth range of 360° was to be monitored, eight phase-controlled antenna, namely, four transmitting antenna and four receiving antenna were required. Consequently, a substantial reduction in outlay is achieved by means of the present invention, in such a case, as only two transmitting antenna and two receiving antenna are required for the desired range.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. In a phased-array antenna in which transmitting energy from a primary feed system is radiated through free space as a primary wave to a plurality of first radiator elements, arranged in rows and columns in a single plane where they are received, and conducted over a plurality of phase shift elements, which may be electronically controlled, and which convert the primary wave into a planar wave and additionally effect a desired beam deflection, with such waves being radiated by a plurality of second radiator elements, in the form of a planar wave, which second radiator elements are likewise arranged in rows and columns in a single plane and are correspondingly disposed with respect to the first radiator elements, and in which received energy passes in the opposite direction along the same path, a second primary feed system being disposed at the second radiator elements with said second primary feed system being supplied with transmitting energy which is radiated through free space, as a primary wave, to the second radiator elements where it is received, conducted over said phase shift elements and radiated by the first radiator elements in the form of a planar wave, said second primary feed system being geometrically positioned relative to the plane of the second radiator elements in exactly the same relation as the first primary feed system is positioned relative to the plane of the first radiator elements, with each of the two primary feed systems being geometrically arranged off-center relative to the particular face of the associated radiator elements, in particular disposed therebelow, the combination of respective delay lines connected in series with the associated phase shift elements, which lines are so designed that they balance the transit time differences associated with the oblique positioning of the primary feed systems and possibly for focusing, and which extend between each of the primary feed systems and the radiator elements associated with the respective phase shift elements.

2. A phased-array antenna according to claim 1, wherein the phase shift elements are electrically reciprocably designed.

3. A phased-array antenna according to claim 1, wherein the plane of the first radiator elements and that of the second radiator elements are parallel to one another and are coextensive.

4. A phased-array antenna according to claim 1, wherein the first radiator elements and the second radiator elements are designed for waves of different polarization and that each of the two primary radiator systems agree with respect to the direction of polarization of its transmitted electromagnetic waves with the polarization of the radiator elements which it directly irradiates over free space.

5. A phased-array antenna according to claim 4, wherein the planes of the two polarizations are at right angles to one another.

6. A phased-array antenna according to claim 5, wherein the two polarization planes are inclined by 45° relative to the vertical.

7. A phased-array antenna according to claim 1, wherein a single transmitter is provided for transmission, which simultaneously operates the two primary feed systems.

8. A phased-array antenna according to claim 1, for utilization in a pulse radar system, wherein a single transmitter is provided for transmission, which alternately operates the two primary feed systems in time division multiplex operation.

9. A phased-array antenna according to claim 8, wherein the primary feed systems are in each case so connected to the transmitter that in each case several transmitting pulses are emitted from the respective primary feed system.

10. A phased-array antenna according to claim 8, wherein the two primary feed systems are connected to the transmitter shortly after one another and a receiver is provided for each of the two primary feed systems.

11. A phased-array antenna according to claim 8, wherein the two primary feed systems are constructed to operate with different frequencies.

12. A phased-array antenna according to claim 1, wherein the respective parallel planes of the first and second radiator elements are inclined with respect to the vertical.

13. A phased-array antenna according to claim 1, for monitoring the full azimuth of 360°, wherein two sets of primary feed systems and cooperable radiators and phase shift elements are employed, and one of which sets has its antenna faces displaced in the azimuth by 90° in relation to the faces of the other set.

14. A phased-array antenna according to claim 1, wherein the antenna exclusively forms a receiving antenna.

15. A phase-array antenna according to claim 1, wherein the antenna exclusively forms a transmitting antenna.

* * * * *